US006244006B1

(12) United States Patent
Shue et al.

(10) Patent No.: US 6,244,006 B1
(45) Date of Patent: Jun. 12, 2001

(54) VENT PIPE COVER PROTECTIVE DEVICE

(76) Inventors: Richard Shue; Michael Shue, both of 2156 10th St., Sarasota, FL (US) 34237

( * ) Notice: Subject to any disclaimer, the term of this patent is extended or adjusted under 35 U.S.C. 154(b) by 0 days.

(21) Appl. No.: 09/391,975

(22) Filed: Sep. 8, 1999

(51) Int. Cl.[7] ..... E04F 17/00
(52) U.S. Cl. ..... 52/302.1
(58) Field of Search ..... 52/302.1, 302.6, 52/302.7, 199, 58

(56) References Cited

U.S. PATENT DOCUMENTS

| | | | | |
|---|---|---|---|---|
| 3,797,181 | | 3/1974 | Nievelt | 52/105 |
| 4,115,961 | * | 9/1978 | Bishop | 52/58 |
| 4,206,692 | | 6/1980 | Johnston | 98/122 |
| 4,399,743 | | 8/1983 | Izzi, Sr. | 98/122 |
| 4,442,643 | | 4/1984 | Stadheim | 52/219 |
| 4,484,424 | * | 11/1984 | Logsdon | 52/199 |
| 4,955,167 | * | 9/1990 | Holtsgreve | 52/199 |
| 5,234,582 | * | 8/1993 | Savoie | 52/12 X |
| 5,402,613 | * | 4/1995 | Giumenta et al. | 52/199 X |
| 5,427,417 | * | 6/1995 | Lechuga | 52/12 X |
| 5,694,724 | | 12/1997 | Santiago | 52/219 |
| 5,778,611 | * | 7/1998 | Michel | 52/58 X |
| 5,979,505 | * | 11/1999 | Drechsel | 138/32 |

* cited by examiner

*Primary Examiner*—Daniel P. Stodola
*Assistant Examiner*—Erica B. Harris

(57) ABSTRACT

A vent pipe cover protective device for a plumbing vent stack having a weatherproofing cover formed substantially of lead material permanently secured over the vent stack. The protective device completely covers the exposed surface of the weatherproof cover so as to prevent access thereto for chewing and consuming any of the lead material by rodents such as squirrels and rats. The upper end of the protective device includes an end piece having apertures such as provided by a screen or mesh material or a drilled plate which are of sufficient size to allow the free upward escape of sewer gas and which are sufficiently small in size so as to prevent, rodents, rats, and other critters such as roaches, birds and snakes from entering into the vent stack itself.

3 Claims, 2 Drawing Sheets

E
D
C
G
16
18
14
10
12
20
14
A
B

VENT PIPE COVER PROTECTIVE DEVICE

BACKGROUND OF THE INVENTION

1. Scope of Invention

This invention relates generally to plumbing vent stacks that extend above a roof of a building for venting sewer gas, and more particularly for protecting the weatherproofing lead cover installed over the tubular vent stack.

2. Prior Art

A plumbing vent stack protrudes through a roof deck and is necessary to vent and disperse sewer gases from each sewer trap in a building or dwelling. To weatherproof this plumbing stack, a cover, formed of substantially lead material and having a tubular upright member connected to a flat flange, is fitted over the plumbing vent stack. After this weatherproofing cover is fitted over the vent stack and permanently secured to the roofing deck, the tubular portion, having a length substantially longer than that of the protruding vent stack, is manually hammered and forced over the distal end of the vent stack and down thereinto to effect a complete weatherproof sealing against wind and rain into the building around the vent stack.

Applicants are building contractors and have encountered situations wherein the outer lead cover has been chewed and even eaten away in parts by rodents such as squirrels and rats which easily gain access to the roof and to the cover over the vent stack. Of course, if the lead cover is chewed sufficiently to form a hole, the weatherproofing integrity is substantially compromised and the entire lead cover must be replaced or the hole effectively patched.

In addition to these rodents having access to the roof area, other critters such as snakes, birds, roaches and other larger bugs likewise may find their way to this area of the roof and into the vent stack. Routinely, such unwanted critters manage to climb down the vent stack, through the sewer trap and into the dwelling through a toilet, sink or drain area. Nests and dead animals trapped in the vent stack will also cause obvious problems.

Applicants are aware of a number of prior art devices which are intended to in some fashion enhance the basic function and structure of a conventional vent stack as follows:

U.S. Pat. No. 5,694,724 issued to Santiago

U.S. Pat. No. 4,399,743 issued to Izzi

U.S. Pat. No. 4,206,692 issued to Johnston

U.S. Pat. No. 3,797,181 issued to Nievelt

U.S. Pat. No. 4,442,643 issued to Stadheim

Specifically, the Stadheim '643 reference teaches an insulating sleeve for preventing interior frosting of the vent stack during colder winter months. The Nievelt '181 patent teaches a very complex structure for weatherproofing a roof vent pipe having molded inner and outer sleeves for encapsulating the upper end of the vent pipe. This device appears to be intended to fully replace the conventional lead cover above described.

Johnson, in U.S. Pat. No. '692, teaches a vent stack cover formed in the flat and manually manipulable into a shape which attaches over the distal open end of the vent pipe for preventing debris from entering the vent pipe itself. The Izzi invention in U.S. Pat. No. '743 teaches a cap which is installable over the distal open end of the vent pipe which includes a vandalism proof attaching means therewith.

The vent pipe cover invented by Santiago in U.S. Pat. No. '724 also teaches a plumbing vent stack cover or guard which replaces the conventional lead cover and which is molded of plastic in one piece to perhaps more effectively accomplish the purposes of the lead weatherproofing cover.

However, where a conventional lead cover is utilized, this mode of weatherproofing still remaining the most popular among building contractors to date, no consideration has been given to both prevent rodents from chewing and attacking the weatherproof integrity of the lead cover and also to prevent such rodents and other larger critters such as snakes, roaches and the like from entering into the vent stack itself.

BRIEF SUMMARY OF THE INVENTION

This invention is directed to a vent pipe cover protective device for a plumbing vent stack having a weatherproofing cover formed substantially of lead material permanently secured over the vent stack. The protective device completely covers the exposed surface of the weatherproof cover so as to prevent access thereto for chewing and consuming any of the lead material by rodents such as squirrels and rats. The upper end of the protective device includes an end piece having apertures such as provided by a screen or mesh material or a drilled plate which are of sufficient size to allow the free upward escape of sewer gas and which are sufficiently small in size so as to prevent, rodents, rats, and other critters such as roaches, birds and snakes from entering into the vent stack itself.

It is therefore an object of this invention to provide a protective device for the combination of a vent pipe cover and vent stack therewithin which prevents rodents from chewing and attacking the weatherproof integrity of the outer cover formed of lead material.

It is yet another object of this invention to provide a vent pipe cover protective device which prevents rodents and other critters such as snakes, roaches and other critters of like size from entering into the vent stack while permitting the full free release of sewer gases upwardly therethrough.

It is still another object of this invention to provide a combination vent pipe cover protective device which both prevents rodents such as squirrels and rats from chewing and consuming portions of the outer lead cover fitted over a vent stack and which also prevents such critters and others such as roaches, birds, mice and snakes from entering into the building through the vent stack.

Yet another object of this invention is to provide the above features in a protective device which is easily replaceable.

In accordance with these and other objects which will become apparent hereinafter, the instant invention will now be described with reference to the accompanying drawings.

DETAILED DESCRIPTION OF THE INVENTION

Figure 1:
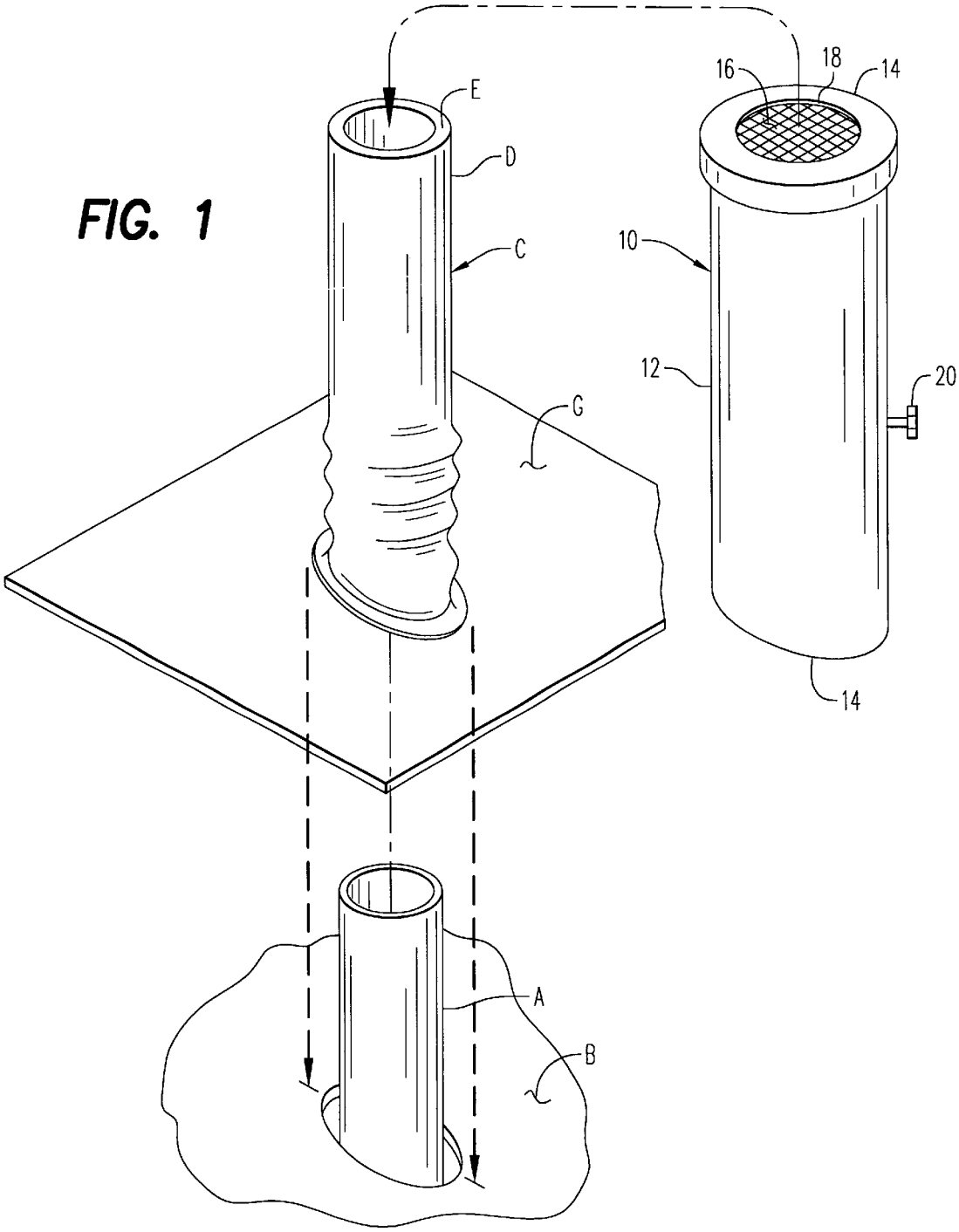
FIG. 1 is an exploded perspective view of the invention in conjunction with a conventional vent stack and weatherproofing lead cover.

Referring now to the drawings, prior art teaches a conventional vent stack A formed of elongated tubular material, now typically formed of plastic or pvc. The upright vent stack A extends upwardly from a sewer trap through an enlarged hole formed in the roof or deck B of the building. In order to render this arrangement weatherproof, one very popular and still well-used economical arrangement in the form of a cover C is utilized. This vent stack cover C, formed substantially of lead, includes an elongated tubular member D rigidly attached to a roof flange G which is attached by mechanical fasteners and sealing material atop the roofing deck B.

Figure 2:
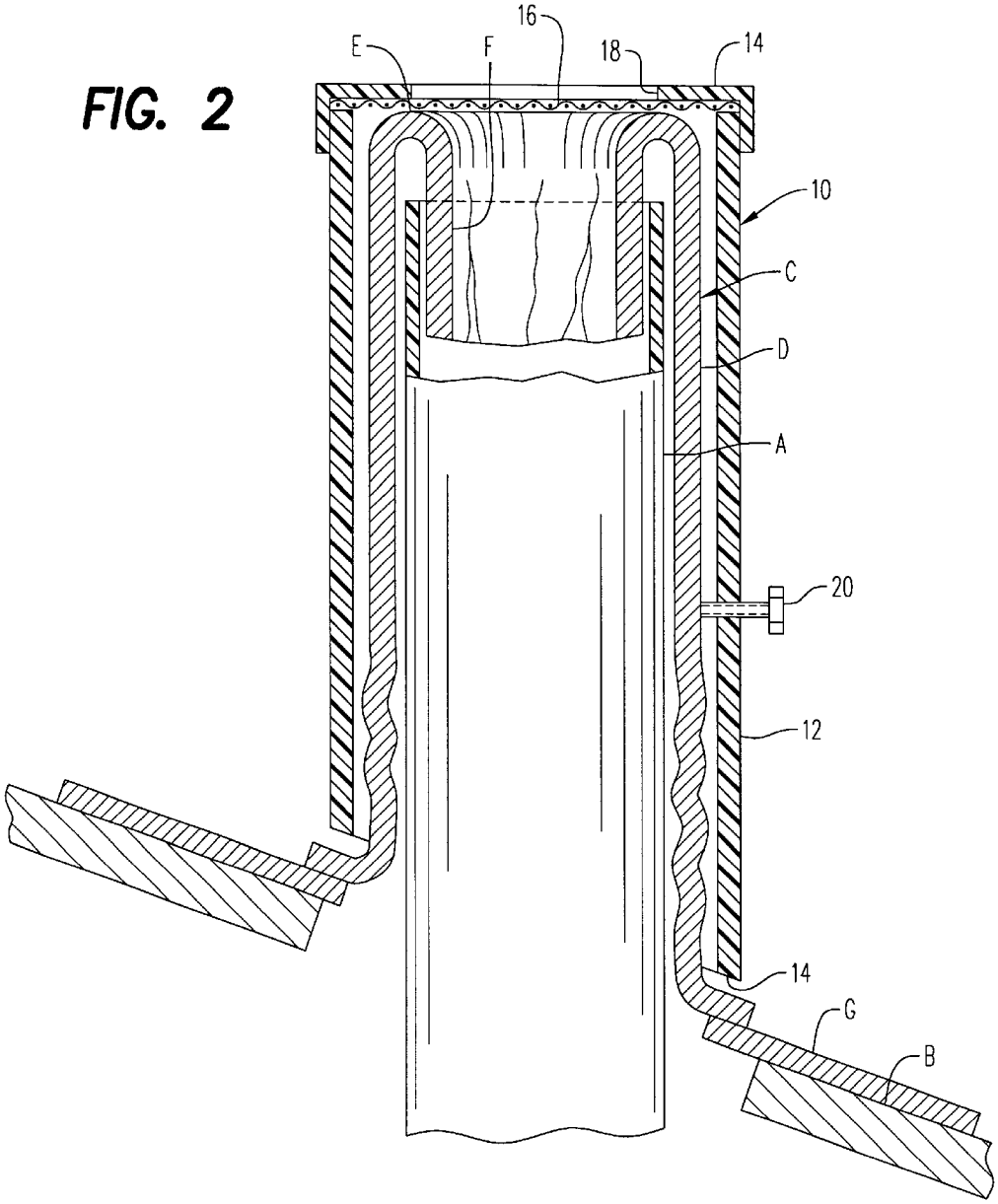
FIG. 2 is a broken longitudinal section view through FIG. 1 as assembled.

The elongated tubular member D of the weatherproofing cover C is somewhat longer in length than that of the exposed portion of the vent stack A. The excess tubular material is hammered and formed over and into the upper distal end of the vent stack A as best seen in FIG. 2 at F so as to completely encapsulate or surround the upper distal portion of the vent stack A.

As discussed earlier, for some unknown strange, perhaps mystical reason, rodents such as squirrels and rats seem to find the contents of the lead material used to form these lead vent stack covers D appetizing, or at least chewable. Applicants, being building contractors, have routinely encountered situations where rodents have chewed through a side wall of the tubular member D destroying the weatherproof integrity of the installation. In such circumstance, the typical remedy is to simply replace the entire weatherproof cover C in its entirety, requiring disturbing the existing sealant and surrounding roofing material.

The present invention is shown generally at numeral 10 and includes an elongated sleeve 12 sized in diameter to slidingly but snugly fit over the tubular member D and having a length generally equal to that of the cover C as installed. In practical terms, this sleeve 12 will be made somewhat longer so that an installer can cut the sleeve 12 at 14 at a proper length and angled matching the slope of the roof.

The upper end of sleeve 12 is enclosed by a cap 22 bonded or otherwise securely connected thereto. The end piece or cap 22 includes a central aperture 18 which is covered by a screened mesh material 16. The screen mesh 16 has apertures formed or inherently present therethrough which are sized to allow sewer gas to be dispersed upwardly from the vent stack A, but of a size sufficiently small so as to prevent rodents such as squirrels, mice and rats and other critters such as roaches, birds and snakes from gaining access into the vent stack A and thusly into the building itself. This aperture size ranges from about ⅛" to ¼" maximum for accomplishing these functions.

To retain the assembled arrangement of the protective device 10 over the weatherproofing cover C, a mechanical fastener 20 threadably engaged through the sleeve 12 so as to forcibly impinge against the outer surface of the tubular member D is provided. However, other forms of releasible attachment of the protective device 10 are envisioned such as a silicone sealant placed strategically between the tubular members D and the sleeve 12. Mere friction resulting from a somewhat forced fit between sleeve 12 and tubular member D also serves this purpose.

In general, the invention has a dual purpose—to deal with rodent chewing of the existing lead weatherproofing cover D and to prevent access of rodents, birds and critters into the vent stack A. The preferred embodiment above described at numeral 10 accomplishes both.

However, material selection for the device 10 may be made either on the basis of its anticipated distaste to chewing rodents such as plastic or aluminum based upon experience, or the selection may be of any convenient material and when chewed through, the sacrificial device is simply replaced. Chewing through the device 10 will not compromise weatherproofing integrity of the vent stack A and weatherproofing cover C so long as replacement is promptly effected when damage occurs.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. For a plumbing vent stack which extends upwardly from a roof from a sewer trap and having a weatherproofing cover open at an upper end thereof and formed substantially of lead material permanently secured over an entire exposed portion of said vent stack projecting above the roof, the lead material being susceptible to being eaten and chewed by rodents, the improvement comprising a replaceable protective device consisting of:

an elongated substantially uninterrupted sleeve open at a lower end thereof and having a width sufficient for sliding engagement over the cover and a length greater than the width thereof and sufficient to protectively cover substantially an entire length of the cover from rodents that would otherwise have eating and chewing access to the lead material in the cover;

an end piece having a width such that said end piece is closely received by and securely attached to and enclosing an upper end of said sleeve, said end piece having openings sufficient in size for venting sewer gas upwardly therethrough from the vent stack;

means positioned between said cover and said sleeve for providing releasable engagement between said protective device and said cover.

2. A replaceable rodent chewing preventing device in combination with a weatherproofing cylindrical cover open at an upper end thereof and formed substantially of lead material and permanently secured in place over a plumbing vent stack projecting above a roof, the lead material being susceptible to eating and chewing deterioration by rodents, said device consisting of:

an elongated sleeve open at a lower end thereof and having a width sufficient for sliding engagement over the cover and a length sufficient to protectively conceal the entire length of the cover from rodents that would otherwise have eating and chewing access to the lead material in the cover;

an end piece having a width such that said end piece is closely received by and securely attached to and enclosing another end of said sleeve, said end piece having openings sufficient in size for venting sewer gas therethrough from the vent stack.

3. A method for preventing rodents from destructively chewing a lead weatherproof cover which is permanently secured around a generally cylindrical plumbing vent stack which upwardly projects from a roof, comprising the steps of:

A. providing a roof vent pipe cover protective device consisting of:

an elongated substantially uninterrupted sleeve open at a lower end thereof and having a width sufficient for sliding engagement over the cover and a length sufficient to protectively conceal the entire cover from rodents which would otherwise have eating and chewing access to the lead material in the cover;

an end piece having a width such that said end piece is closely received by and securely attached to, and enclosing an upper end and substantially no greater in width than the width of said sleeve, said end piece having openings sufficient in size for venting sewer gas therethrough from the vent stack;

B. slidingly engaging and securing said device such that said device covers an entire length of the cover.

* * * * *